US008575832B2

(12) United States Patent
Yang et al.

(10) Patent No.: US 8,575,832 B2
(45) Date of Patent: Nov. 5, 2013

(54) FIELD EMISSION DISPLAY

(75) Inventors: Tzung-Han Yang, Taipei (TW); Chi-Tsung Lo, Taipei (TW)

(73) Assignee: Tatung Company, Taipei (TW)

( * ) Notice: Subject to any disclaimer, the term of this patent is extended or adjusted under 35 U.S.C. 154(b) by 145 days.

(21) Appl. No.: 13/064,746

(22) Filed: Apr. 13, 2011

(65) Prior Publication Data

US 2012/0153809 A1 Jun. 21, 2012

(30) Foreign Application Priority Data

Dec. 16, 2010 (TW) ..... 99144218 A

(51) Int. Cl.
*H01J 63/02* (2006.01)

(52) U.S. Cl.
USPC ..... 313/495; 313/309; 313/494; 313/496; 313/310; 313/311

(58) Field of Classification Search
USPC ..... 313/495–497, 306, 308–310, 351, 355, 313/292–304; 445/49–51; 257/167, 10–11; 438/20; 315/169.1, 169.3
See application file for complete search history.

(56) References Cited

U.S. PATENT DOCUMENTS

| | | | | |
|---|---|---|---|---|
| 5,637,958 | A * | 6/1997 | Levine | 313/496 |
| 6,445,122 | B1 | 9/2002 | Chuang et al. | |
| 6,727,642 | B1 * | 4/2004 | Cho et al. | 313/496 |
| 2010/0252804 | A1 * | 10/2010 | Cheng et al. | 257/10 |

FOREIGN PATENT DOCUMENTS

| | | |
|---|---|---|
| CN | 1959503 | 5/2007 |
| TV | I256155 | 6/2006 |
| TV | I281684 | 5/2007 |
| TV | I304507 | 7/2007 |

* cited by examiner

*Primary Examiner* — Anh Mai
*Assistant Examiner* — Fatima Farokhrooz
(74) *Attorney, Agent, or Firm* — Bacon & Thomas, PLLC

(57) ABSTRACT

The present invention relates to a field emission display, which includes: a base substrate; a plurality of cathode strips, disposed over the base substrate; an insulating layer, disposed over the cathode strips and having a plurality of openings, therewith the openings corresponding to the cathode strips; a plurality of anode strips, disposed over the insulating layer, where the cathode strips and the anode strips are arranged into a matrix and the anode strips individually have at least one impacted surface; and a plurality of subpixel units, individually including: an emissive region having a phosphor layer disposed over the impacted surface; and at least one emissive protrusion, corresponding to the emissive region and disposed in the openings to electrically connect to the cathode strips and protrude out of the openings. Accordingly, the present invention can enhance light utilization efficiency of a field emission display.

12 Claims, 5 Drawing Sheets

FIELD EMISSION DISPLAY

CROSS REFERENCE TO RELATED APPLICATION

This application claims the benefits of the Taiwan Patent Application Serial Number 099144218, filed on Dec. 16, 2010, the subject matter of which is incorporated herein by reference.

BACKGROUND OF THE INVENTION

1. Field of the Invention

The present invention relates to a field emission display, more particularly, to a field emission display with improved light utilization efficiency.

2. Description of Related Art

In recent years, display devices have played an increasingly important role in daily life. For example, computers, the Internet, televisions, cell phones, personal digital assistants (PDAs) and digital cameras, all have to exchange messages through the control of a display. As compared to conventional cathode ray tube (CRT) displays, new-generation flat panel displays have the light, small and ergonomic features, but they still have the disadvantages of poor viewing angle, low brightness and high power consumption.

Among the technologies of developing flat panel display, field emission displays (FEDs) have the same feature of high image quality as the CRT displays, and the disadvantages found in liquid crystal displays (LCDs), such as poor viewing angle, small range of operating temperature and long response time, can be avoided. Generally, an FED can provide the features of high yield, short response time, great communication for display, thinner and lighter structure, wide angle of view, large range of operating temperature, and good recognition of slanting direction.

FIG. 1 is a schematic view for illustrating the work principle of a field emission display. A field emission display mainly includes a cathode electrode 12, an electron emissive layer 14, an anode electrode 15, a phosphor layer 16 and a gate electrode 19. Herein, the anode electrode 15 and the phosphor layer 16 are formed on the front substrate 17, while the cathode electrode 12; the electron emissive layer 14 and the gate electrode 19 are disposed on the base substrate 11. Accordingly, an electric field is formed between the cathode electrode 12 and the gate electrode 19 when a voltage is applied in-between, and thus the tunnel effect occurs whereby electrons are released from the electron emissive layer 14. Then, a voltage applied on the anode electrode 15 would accelerate the impact of the released electrons to the phosphor layer 16, resulting in the emission of light from the phosphor layer 16. Moreover, the gate electrode 19 can be used to accurately control the time to emit electrons and to increase the electron current density, and the gate electrode 19 and the cathode electrode 12 can be electrically separated from each other by the insulating layer 13.

In general, electrons released from the electron emissive layer 14 merely impact to the surface 161 of the phosphor layer 16, and thus the highest luminous efficiency would be found from the surface 161 of the phosphor layer 16. That is, most of light emitted from the phosphor layer 16 is limited within the device and thus cannot be transmitted outwards. In addition, since the output window of the conventional field emission display is located against the surface 161 of the phosphor layer 16, the light transmitted outward from the surface 161 of the phosphor layer 16 has to pass through the phosphor layer 16, the anode electrode 15, and the front substrate 17, which results in the reduction of light extraction efficiency. Thereby, the aforementioned conventional field emission display generally has the disadvantage of low luminous efficiency.

SUMMARY OF THE INVENTION

The object of the present invention is to provide a field emission display in which the light utilization efficiency is enhanced, and to solve the problem that high cost ITO electrode has to be applied as an anode in the conventional FED.

To achieve the object, the present invention provides a field emission display, including: a base substrate; a plurality of cathode strips, disposed over the base substrate; an insulating layer, disposed over the cathode strips and having a plurality of openings arranged into an array, therewith the openings corresponding to the cathode strips; a plurality of anode strips, disposed over the insulating layer, where the cathode strips and the anode strips are arranged into a matrix and the anode strips individually have at least one impacted surface, therewith the at least one impacted surface being an inclined surface or a curved surface; and a plurality of subpixel units arranged into an array, therewith the subpixel units individually including: an emissive region having a phosphor layer disposed over the at least one impacted surface; and at least one emissive protrusion, corresponding to the emissive region and disposed in the openings to electrically connect to the cathode strips and protrude out of the openings. In detail, each emissive region with one or two emissive protrusions corresponding to one or both sides of the emissive region can constitute a subpixel unit, and plural subpixel units can constitute a pixel unit, resulting in a plurality of pixel units arranged into an array.

The field emission display according to the present invention may further include: a front substrate, disposed above the base substrate. Also, the field emission display according to the present invention further includes: a supporting unit, disposed between the base substrate and the front substrate, and the region between the base substrate and the front substrate can be a vacuum region. Herein, the base substrate may be an insulating substrate, and the front substrate may be a transparent substrate.

In the present invention, the cathode strips and the anode strips are strip-shaped, and the cross section of each anode strip may be, for example, triangle, trapezoid, semicircle or arch. Preferably, the bottom area of each anode strip is larger than the top area. More preferably, the longitudinal section area of each anode strip progressively increases from the top to the bottom thereof. In particular, the anode strips with trapezoid cross section may be used as supporting elements between the base substrate and the front substrate. Additionally, the anode strips may be higher than the emissive protrusions, and the phosphor layer may be disposed merely over the impacted surface at the lateral surface of the anode strip. That is, each anode strip may be provided with no phosphor layer on its top surface, whereas the top surface does not correspond to the emissive protrusion. In the present invention, the anode strip bottom area refers to the area of the anode strip at bottom facing the base substrate, and the anode strip top area refers to the area of the anode strip at top facing the front substrate. In addition, the cross section of an anode strip refers to a sectional surface vertical to the axial direction of the anode strip, and the longitudinal section of an anode strip refers to a sectional surface parallel to the axial direction of the anode strip.

According to the present invention, cathode strips, emissive protrusions, anode strips and the phosphor layer are all placed over the base substrate, while the front substrate as an output window is placed above the surface of the phosphor layer where the highest luminous efficiency can be found. In comparison with the conventional FED where the output window is located at the bottom of the phosphor layer (i.e. located against the surface of the phosphor layer) and low luminous efficiency is generated, the FED according to the present invention can perform better luminous efficiency and uses no high cost ITO anodes.

Moreover, in the present invention, conductive materials capable of reflecting light are preferably applied to the impacted surface(s) of each anode strip, such that the light transmitted inward to the phosphor layer can be reflected from the impacted surface(s) of each anode strip to the front substrate so as to enhance light extraction efficiency. For example, in the present invention, each anode strip may be a strip-shaped body, which is preferably made of a conductive material capable of reflecting light. Alternatively, each anode strip may include a strip-shaped body and a conductive layer disposed over the strip-shaped body, therewith the conductive layer preferably being made of a conductive material capable of reflecting light, and the strip-shaped body preferably being empty or being made of a conductive material or a non-conductive material. Accordingly, each anode strip according to the present invention, not only functions as an electrode, but also has the effect of reflecting light to enhance the light utilization efficiency of the FED according to the present invention.

In the present invention, each emissive protrusion may include a conductive protrusion and an electron emissive layer, therewith the conductive protrusion being electrically connected to the cathode strip, and the electron emissive layer being located over the conductive protrusion. Herein, the material of the conductive protrusion is not particularly limited, and may be any conventional suitable conductive material. Also, the conductive protrusion is not particularly limited in shape, which may be a rectangular bump or a cylinder bump. In addition, the material of the electron emissive layer according to the present invention is not particularly limited, and may be any conventional suitable electron emissive material, such as nano carbon materials, inclusive of carbon nanotubes and carbon nanowalls.

In the present invention, the phosphor layer is not particularly limited in material, and any conventional suitable fluorescent powder or phosphorous powder may be used. In addition, each of the emissive regions may produce visible light of the same color, such that the FED according to the present invention may be a monochrome FED. In the alternative, some of the emissive regions may emit visible light of a different color to others of the emissive regions, and thus the emissive regions may include plural emissive regions capable of emitting light with different colors (such as red emissive regions, blue emissive regions and green emissive regions) to achieve the effect of color displaying.

As mentioned above, in the present invention, all main components (i.e. cathode strips, emissive protrusions, anode strips and the phosphor layer) are placed over the base substrate, while the front substrate being as an output window is placed over the surface of the phosphor layer where the highest luminous efficiency can be found. In comparison with the conventional FED where the output window is located at the bottom of the phosphor layer (i.e. located against the surface of the phosphor layer) and low luminous efficiency is generated, the FED according to the present invention can show greater luminous efficiency. In particular, according to the present invention, conductive materials capable of reflecting light may be used for the impacted surface(s) of each anode strip, such that the light transmitted inward to the phosphor layer can be reflected from the impacted surface(s) of each anode strip to the front substrate to enhance light extraction efficiency. Moreover, the present invention avoids the problem of using high-cost ITO anodes, which are essential in the conventional FED.

DETAILED DESCRIPTION OF THE PREFERRED EMBODIMENT

Hereafter, examples will be provided to illustrate the embodiments of the present invention. Other advantages and effects of the invention will become more apparent from the disclosure of the present invention. It should be noted that these accompanying figures are simplified. The quantity, shape and size of components shown in the figures may be modified according to actual conditions in practice, and the arrangement of components may be more complex. Other various aspects also in the invention may be practiced or applied by definite embodiments, and various modifications and variations can be made without departing from the spirit of the invention based on various concepts and applications.

Example 1

Figure 1:
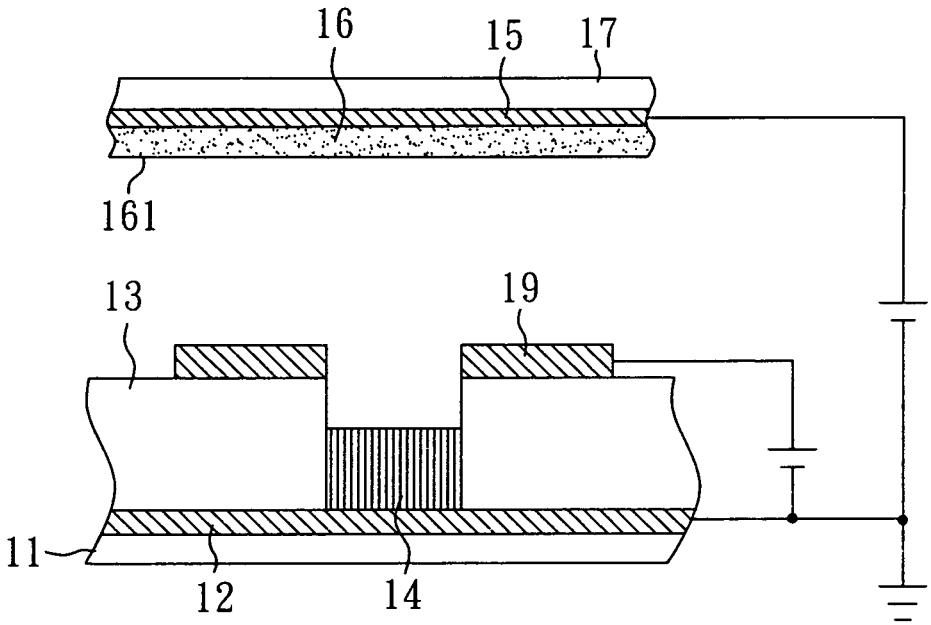
FIG. 1 (PRIOR ART)
FIG. 1 shows a schematic view for illustrating the work principle of a field emission display.
Figure 2A:
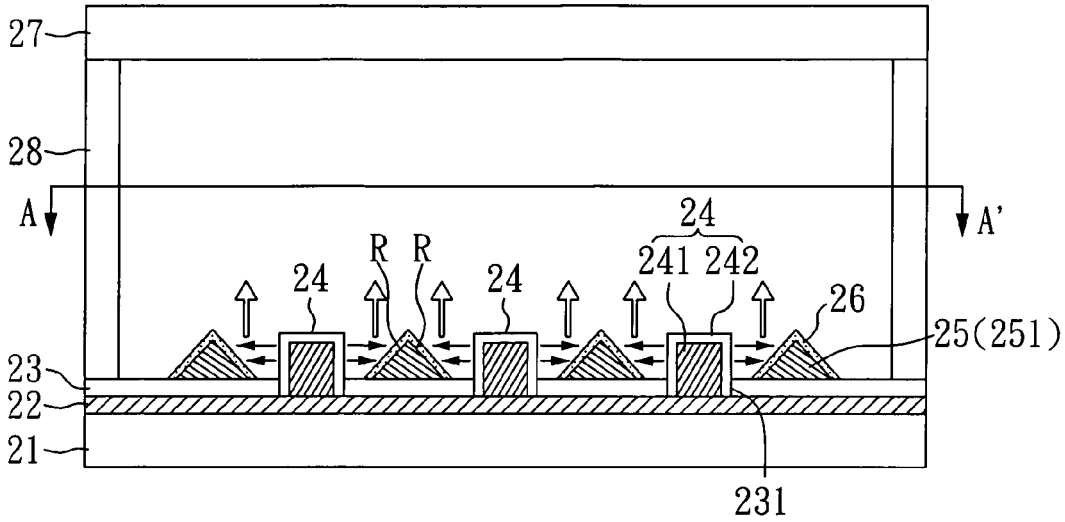
FIG. 2A shows a cross-sectional view of a field emission display according to Example 1 of the present invention.

FIG. 2A shows a cross-sectional view of a field emission display according to one preferred example of the present invention, which mainly includes: a base substrate 21, cathode strips 22, an insulating layer 23, emissive protrusions 24, anode strips 25, a phosphor layer 26, a front substrate 27 and a supporting unit 28. Herein, the supporting unit 28 is disposed between the base substrate 21 and the front substrate 27, and the region between the base substrate 21 and the front substrate 27 is a vacuum region. In addition, the cathode strips 22, the emissive protrusions 24, the anode strips 25 and the phosphor layer 26 are disposed on the base substrate 21, while the front substrate 27 as an output window is disposed above the surface of the phosphor layer 26 where the highest luminous efficiency can be found. Accordingly, in comparison with the conventional field emission display where the output window is located at the bottom of the phosphor layer (i.e. located against the surface of the phosphor layer) and low luminous efficiency is shown, the field emission display according to the present example can present the improvement of luminous efficiency. Particularly, in the field emission display according to the present example, the light transmitted inward to the phosphor layer 26 can be further reflected to the front substrate 27 by the impacted surfaces R of the anode strips 25, resulting in the enhancement of light extraction efficiency.

In detail, as shown in FIG. 2A, each of the cathode strips 22 is formed on the base substrate 21, and an insulating layer 23 is formed on the surface of cathode strips 22 so as to electrically separate the cathode strips 22 from the anode strips 25. In addition, the insulating layer 23 has a plurality of openings 231, which are arranged into an array to expose partial regions of the cathode strips 22, while the emissive protrusions 24 are disposed in the openings 231, electrically connected to the cathode strips 22 and protrude out of the openings 231. In the present example, each of the emissive protrusions 24 includes a conductive protrusion 241 and an electron emissive layer 242, in which the conductive protrusion 241 is electrically connected to its corresponding cathode strip 22, and the electron emissive layer 242 is disposed over the surface of the conductive protrusion 241. Accordingly, electrons can be emitted from the electron emissive layer 242 to impact to the phosphor layer 26 over the anode strips 25, resulting in emission of light.

Figure 2B:
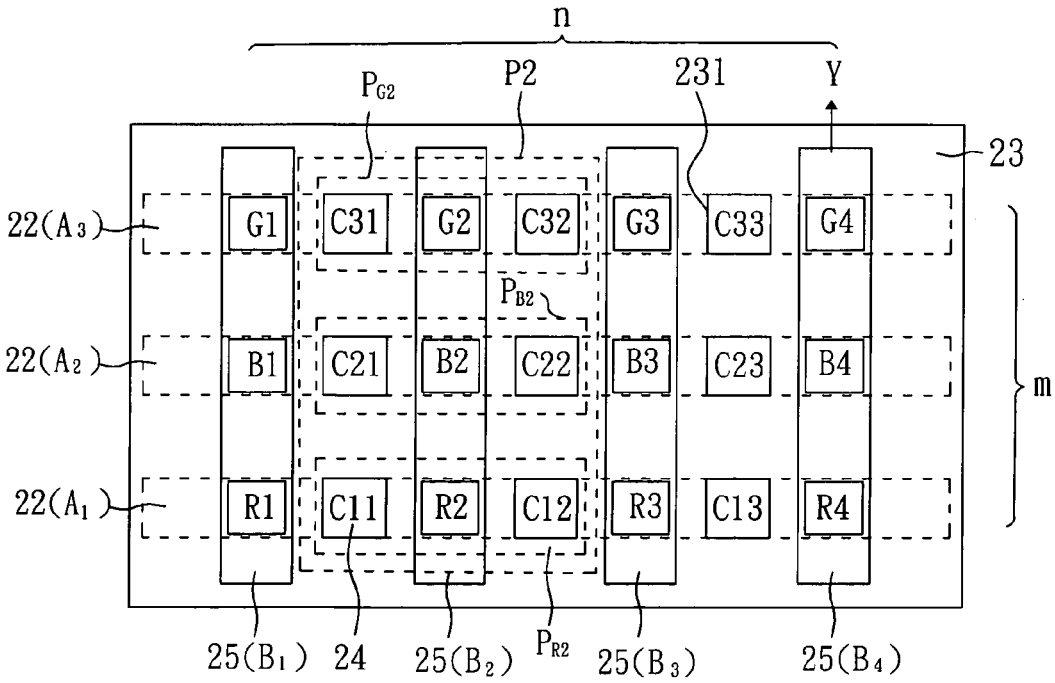
FIG. 2B shows a top view along the line AA' in FIG. 2A.

Moreover, as shown in FIG. 2A, each of the anode strips 25 according to the present example is a strip-shaped body 251 with a triangle cross section (vertical to the axial direction Y of the anode strip 25 shown in FIG. 2B), and the impacted surface R corresponding to the emissive protrusion 24 is an inclined surface. Herein, the phosphor layer 26 is disposed over the impacted surfaces R of the anode strips 25, and the longitudinal section area (parallel to the axial direction Y of the anode strip 25 shown in FIG. 2B) of each anode strip 25 gradually increases from the top to the bottom. Accordingly, the light emitted from the phosphor layer 26 can be transmitted toward the front substrate 27 and projected out of the device. Furthermore, the strip-shaped body 251 as an anode strip 25 according to the present example is made of a conductive material capable of reflecting light, such as aluminum being applied in the present example. Accordingly, when electrons emitted from the electron emissive layer 242 impact to the phosphor layer 26 on the impacted surfaces R of the anode strips 25, the impacted surfaces R of the anode strips 25 would reflect the light emitted from the phosphor layer 26 to the front substrate 27 above the base substrate 21, resulting in the enhancement of light utilization efficiency. In comparison with the conventional field emission display in which an ITO electrode is used as an anode, the present example utilizes a material capable of effectively evacuating charges as the material of the anode strips 25, such that accumulation of charges can be inhibited. Furthermore, no more expensive ITO anode applied and required in the conventional FED has to be used in the FED according to the present example. In the present example, the front substrate 27 is a transparent substrate, such that light reflected from the impacted surfaces R can pass through the front substrate 27 and be transmitted outward.

For further illustration, please see FIG. 2B, which shows a top view along the line AA' in FIG. 2A. As shown in FIG. 2B, in the present example, the plural cathode strips 22 (signed as $A_1$, $A_2$ and $A_3$) are arranged into an array on the base substrate. Herein, the base substrate is an insulating substrate. Then, the insulating layer 23 is disposed over the base substrate and the cathode strips 22, and has a plurality of openings 231 arranged into an array to expose the partial regions of the corresponding cathode strips 22. Subsequently, a plurality of emissive protrusions 24 are formed in the openings 231, and the emissive protrusions 24 are electrically connected to the corresponding cathode strips 22 and protruded out of the openings 231. Finally, a plurality of triangle-shaped anode strips 25 (signed as $B_1$, $B_2$, $B_3$ and $B_4$) are arranged into an array on the insulating layer 23 to form a m×n matrix with the cathode strips 22 (the present example takes a 3×4 matrix for illustration), and the emissive protrusions 24 are located between adjacent anode strips 25. Herein, a phosphor layer are provided on the impacted surfaces, while the impacted surfaces are located at two lateral sides of the anode strips 25 and correspond to the emissive protrusions 24, such that a plurality of emissive regions (i.e. red emissive regions R1, R2, R3 and R4, blue emissive regions B1, B2, B3 and B4, and green emissive regions G1, G2, G3 and G4) are defined. Each emissive region and its corresponding emissive protrusion(s) 24 constitute a subpixel unit (such as $P_{R2}$, $P_{B2}$, $P_{G2}$), and every three subpixel units (such as $P_{R2}$, $P_{B2}$, $P_{G2}$) capable of emitting different colored light would constitute a pixel unit (such as P2). In detail, the green emissive region G2 and the emissive protrusions C31 and C32 at its both sides constitute a subpixel unit $P_{G2}$, the blue emissive region B2 and the emissive protrusions C21 and C22 at its both sides constitute a subpixel unit $P_{B2}$; and the red emissive region R2 and the emissive protrusions C11 and C12 at its both sides constitute a subpixel unit $P_{R2}$, therewith the three subpixel units, $P_{R2}$, $P_{B2}$, and $P_{G2}$, constituting a pixel unit P2. Similarly, the green emissive region G3, the blue emissive region B3 and the red emissive region R3 respectively with their corresponding emissive protrusions C32 and C33, C22 and C23, C12 and C13 at both sides thereof constitute another three subpixel units, and thus the three subpixel units constitute another pixel unit. Besides, the green emissive region G1, the blue emissive region B1 and the red emissive region R1 respectively with the emissive protrusions C31, C21 and C11 at single side thereof also constitute three subpixel units, and the three subpixel units constitute a pixel unit. Similarly, the green emissive region G4, the blue emissive region B4 and the red emissive region R4 respectively with the emissive protrusions C33, C23 and C13 at single side thereof constitute another three subpixel units, and the three subpixel units constitute another pixel unit.

Accordingly, for example, when low potential and high potential are applied to the cathode strip $A_1$ and the anode strip $B_2$, respectively, electrons would be emitted from the emissive protrusions C11 and C 12 to impact to the red emissive region R2, such that the red emissive region R2 in the subpixel unit $P_{R2}$ would emit red light. Accordingly red light is emitted from the pixel unit P2. In the case of applying low potential and high potential to the cathode strips $A_1$, $A_2$ and the anode strip $B_2$, respectively, electrons would be emitted from the emissive protrusions C11, C12, C21, and C22 to impact to the red emissive region R2 and the blue emissive region B2, such that the red emissive region R2 and the blue emissive region B2 would emit red light and blue light, respectively. Accordingly, the mixture of red light and blue light would be provided from the pixel unit P2. Similarly, when low potential and high potential are applied to the cathode strips $A_1$, $A_2$, $A_3$ and the anode strip $B_2$, respectively, electrons would be emitted from the emissive protrusions C11, C12, C21, C22, C31, C32 to impact to the respective red emissive region R2, blue emissive region B2 and green emissive region G2, such that the red emissive region R2, the blue emissive region B2 and the green emissive region G2 would emit red light, blue light and green light. Accordingly, a mixture of red light, blue light and green light would be provided from the pixel unit P2. Moreover, the emission intensity of each subpixel unit can be modified by controlling input voltage.

As mentioned above, the cathode strips $A_1$, $A_2$, $A_3$ and the anode strips $B_1$, $B_2$, $B_3$, $B_4$ can be selectively applied with low potential and high potential according to input signals to selectively drive the plural subpixel units (such as $P_{R2}$, $P_{B2}$, $P_{G2}$) in the m×n matrix. Herein, each pixel unit consists of three subpixel units (i.e. the red emissive region, the blue emissive region and the green emissive region), and thus the color and gray scale of each pixel unit can be modified by controlling subpixel units, to achieve the color displaying effect.

Example 2

Figure 3:
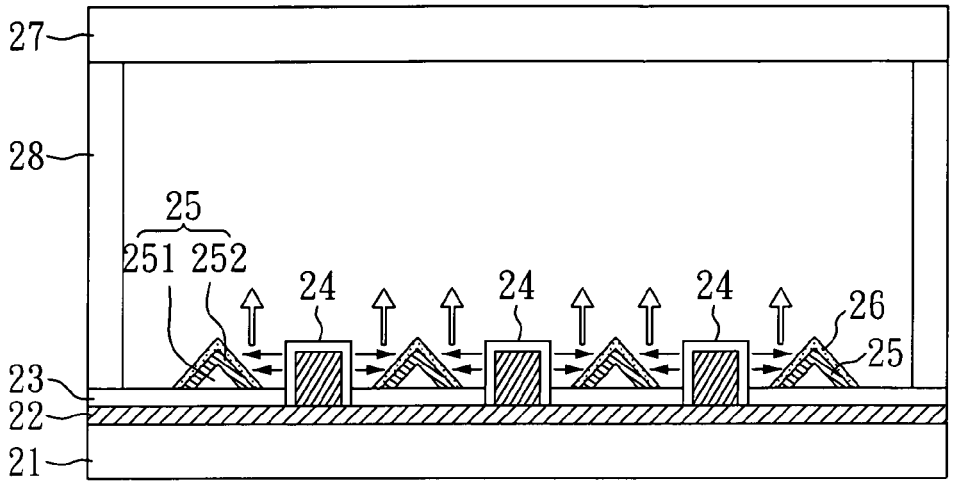
FIG. 3 shows a cross-sectional view of a field emission display according to Examples 2 and 3 of the present invention.

The field emission display according to the present example is almost the same as that was illustrated in Example 1, except that each anode strip 25 according to the present example consists of a strip-shaped body 251 and a conductive layer 252, as shown in FIG. 3. Herein, the strip-shaped body 251 is made of a non-conductive material, and the conductive layer 252 is made of a conductive material capable of reflecting light (e.g. aluminum is used for the conductive layer in the present example) so as to reflect light and to conduct current.

Example 3

The field emission display according to the present example is almost the same as that was illustrated in Example 2, except that the strip-shaped body 251 of each anode strip 25 according to the present example is empty, as shown in FIG. 3.

Example 4

Figure 4:
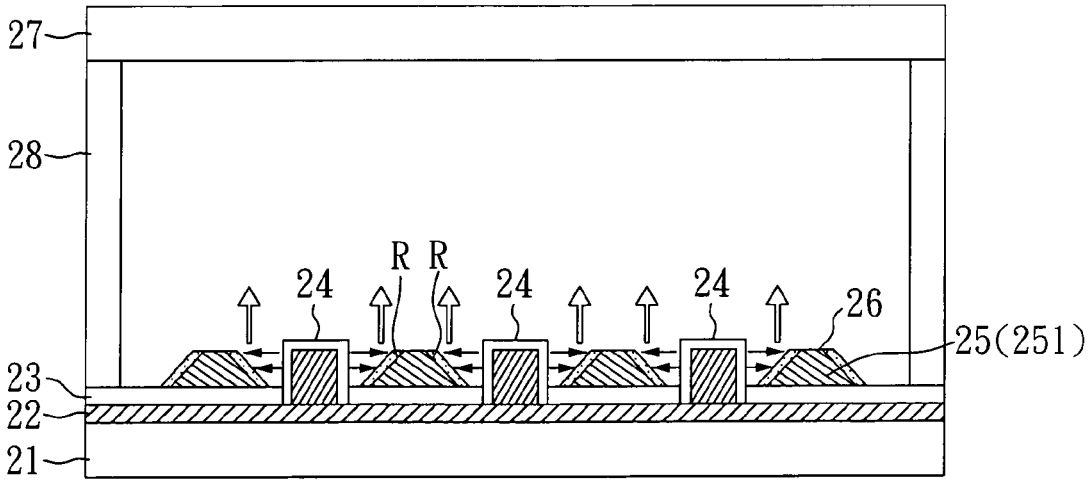
FIG. 4 shows a cross-sectional view of a field emission display according to Example 4 of the present invention.

The field emission display according to the present example is almost the same as that was illustrated in Example 1, except that each anode strip 25 according to the present example consists of a strip-shaped body 251 with a trapezoid cross section, as shown in FIG. 4. Herein, two lateral inclined surfaces of the anode strip 25, which correspond to the emissive protrusions 24, are defined as impacted surfaces R, and each impacted surface R is provided with a phosphor layer 26 thereon.

In addition, according to another aspect of the present example, the top of each anode strips 25 can contact directly with the front substrate 27 and is provided with no phosphor layer 26 thereon. That is, the phosphor layer 26 is disposed merely on two lateral surfaces of the anode strips 25. Accordingly, the anode strips 25 can function as supporting elements between the base substrate 21 and the front substrate 27.

Example 5

Figure 5:
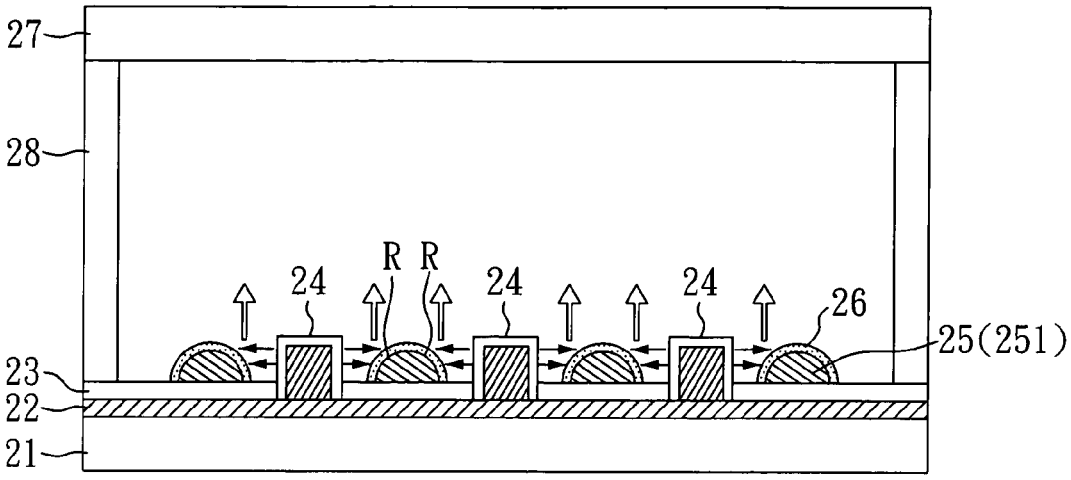
FIG. 5 shows a cross-sectional view of a field emission display according to Example 5 of the present invention.

The field emission display according to the present example is almost the same as that was illustrated in Example 1, except that each anode strip 25 according to the present example consists of a strip-shaped body 251 with a semicircular cross section, as shown in FIG. 5. Herein, the two lateral curved surfaces of the anode strip 25, which correspond to the emissive protrusions 24, are defined as impacted surfaces R, and each impacted surface R is provided with a phosphor layer 26 thereon.

Example 6

Figure 6:
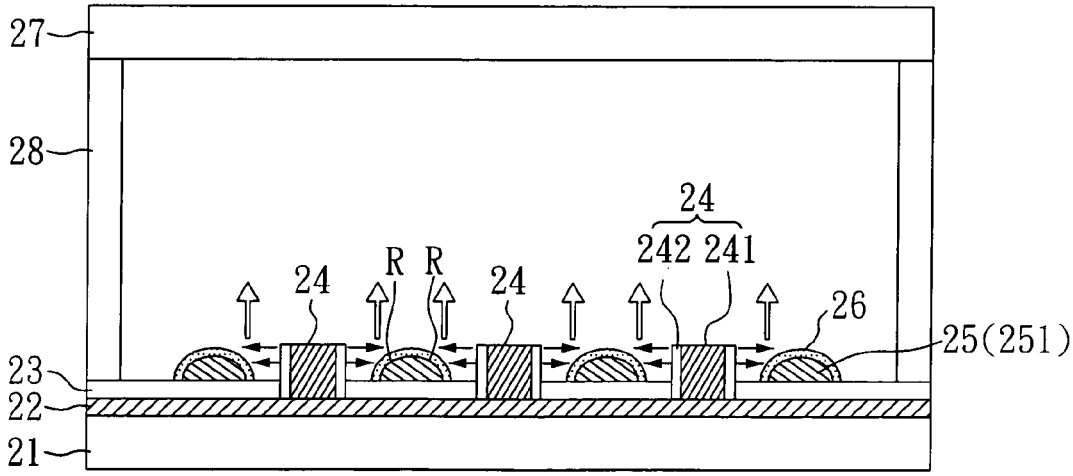
FIG. 6 shows a cross-sectional view of a field emission display according to Example 6 of the present invention.

The field emission display according to the present example is almost the same as that was illustrated in Example 1, except that each anode strip 25 according to the present example consists of a strip-shaped body 251 with an arch-shaped cross section, as shown in FIG. 6. Herein, the two lateral curved surfaces of the anode strip 25, which correspond to the emissive protrusions 24, are defined as impacted surfaces R, and each impacted surface R is provided with a phosphor layer 26 thereon. In addition, the electron emissive layer 242 of each emissive protrusion 24 is disposed merely on the lateral surfaces of the conductive protrusion 241, which correspond to the anode strips 25. That is, the top of each conductive protrusion 241 is provided with no electron emissive layer 242.

Example 7

Figure 7:
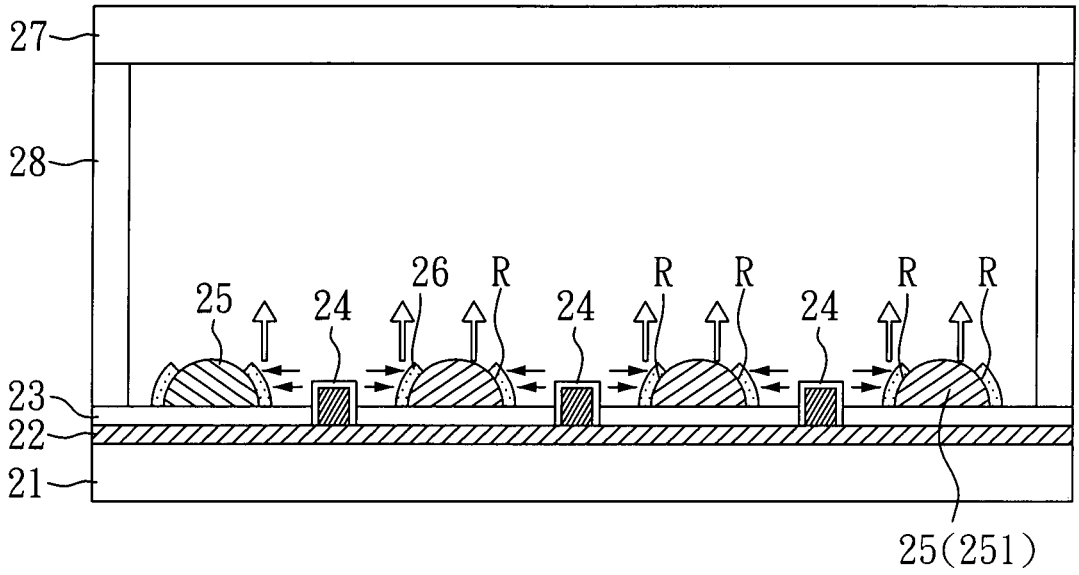
FIG. 7 shows a cross-sectional view of a field emission display according to Example 7 of the present invention.

The field emission display according to the present example is almost the same as that was illustrated in Example 5, except that each anode strip 25 according to the present example is higher than the emissive protrusion 24, and each anode strip 25 is provided with the phosphor layer 26 merely on its impacted surfaces R (i.e. its lateral surfaces corresponding to the emissive protrusions 24), as shown in FIG. 7. That is, each anode strip 25 is provided with no phosphor layer 26 on its top, while the top of anode strip 25 does not correspond to the emissive protrusion 24.

Accordingly, in the present invention, all main components (i.e. cathode strips, emissive protrusions, anode strips and the phosphor layer) are placed over the base substrate, while the front substrate as the output window is placed over the surface of the phosphor layer where the highest luminous efficiency can be found. In comparison with the conventional FED where the output window is located at the bottom of the phosphor layer (i.e. located against the surface of the phosphor layer) and low luminous efficiency is generated, the FED according to the present invention can perform better luminous efficiency. In particular, according to the present invention, conductive materials capable of reflecting light may be applied to the impacted surfaces of anode strips, such that the light transmitted inward to the phosphor layer can be reflected from the impacted surfaces of anode strips to the front substrate so as to enhance light extraction efficiency. Moreover, the present invention uses no high cost ITO anodes, which have to be used in the conventional FED.

The above examples are intended for illustrating the embodiments of the subject invention and the technical features thereof, but not for restricting the scope of protection of the subject invention. The scope of the subject invention is based on the claims as appended.

What is claimed is:

1. A field emission display, comprising:

a base substrate;

a plurality of cathode strips, disposed over the base substrate;

an insulating layer, disposed over the cathode strips and having a plurality of openings, wherein the openings correspond to the cathode strips and are arranged into an array;

a plurality of anode strips, disposed over the insulating layer, wherein the cathode strips and the anode strips are electrically separated from each other by the insulating layer and arranged into a matrix, and each of the anode strips has at least one impacted surface, therewith the at least one impacted surface being an inclined surface or a curved surface; and a plurality of subpixel units arranged into an array, wherein each of the subpixel units comprises: an emissive region having a phosphor layer disposed over the at least one impacted surface; and at least one emissive protrusion, corresponding to the emissive region and disposed in the openings to electrically connect to the cathode strips and protrude out of the openings, wherein the cathode strips, the insulating layer, the anode strips and the subpixel units are placed at the base substrate, and the impact surface is opposite to and faces a surface of the emissive protrusion.

2. The field emission display as claimed in claim 1, wherein color of light emitted from the emissive region comprised in one of the subpixel units is different from that comprised in another one of the subpixel units.

3. The field emission display as claimed in claim 1, wherein each of the anode strips has a larger bottom area than a top area.

4. The field emission display as claimed in claim 2, wherein the emissive region comprised in one of the subpixel units is a red emissive region, a blue emissive region or a green emissive region.

5. The field emission display as claimed in claim 3, wherein each of the anode strips has a triangle, trapezoid, half-circle or arch cross section.

6. The field emission display as claimed in claim 3, wherein the at least one impacted surface is made of a conductive material capable of reflecting light.

7. The field emission display as claimed in claim 3, further comprising: a front substrate, disposed above the base substrate.

8. The field emission display as claimed in claim 3, wherein each of the emissive protrusions comprises a conductive protrusion and an electron emissive layer, and the electron emissive layer is disposed over the conductive protrusion.

9. The field emission display as claimed in claim 3, wherein the anode strips are higher than the emissive protrusions.

10. The field emission display as claimed in claim 6, wherein each of the anode strips is a strip-shaped body, and the strip-shaped body is made of the conductive material capable of reflecting light.

11. The field emission display as claimed in claim 6, wherein each of the anode strips comprises a strip-shaped body and a conductive layer disposed over the strip-shaped body, therewith the conductive layer being made of the conductive material capable of reflecting light.

12. The field emission display as claimed in claim 7, further comprising: a supporting unit, disposed between the base substrate and the front substrate, wherein a region between the base substrate and the front substrate is a vacuum region.

* * * * *